US008289268B2

(12) United States Patent
Park

(10) Patent No.: US 8,289,268 B2
(45) Date of Patent: Oct. 16, 2012

(54) APPARATUS AND METHOD FOR IMPROVING VIDEO QUALITY OF DISPLAY DEVICE

(75) Inventor: Sang-Heon Park, Gumi (KR)

(73) Assignee: LG Electronics Inc., Seoul (KR)

( * ) Notice: Subject to any disclaimer, the term of this patent is extended or adjusted under 35 U.S.C. 154(b) by 703 days.

(21) Appl. No.: 12/438,887

(22) PCT Filed: Sep. 6, 2007

(86) PCT No.: PCT/KR2007/004321

§ 371 (c)(1),
(2), (4) Date: May 8, 2009

(87) PCT Pub. No.: WO2008/038911

PCT Pub. Date: Apr. 3, 2008

(65) Prior Publication Data

US 2009/0322733 A1 Dec. 31, 2009

(30) Foreign Application Priority Data

Sep. 27, 2006 (KR) ..... 10-2006-0094089

(51) Int. Cl.
*G09G 3/36* (2006.01)

(52) U.S. Cl. ..... 345/102
(58) Field of Classification Search ..... 345/102
See application file for complete search history.

(56) References Cited

U.S. PATENT DOCUMENTS

2004/0008176 A1 1/2004 Nuimura

FOREIGN PATENT DOCUMENTS

| | | | |
|---|---|---|---|
| JP | 10-213789 | A | 8/1998 |
| JP | 2003-255913 | A | 9/2003 |
| KR | 20-0225839 | Y1 | 3/2001 |
| KR | 10-2004-0103549 | A | 12/2004 |
| KR | 10-0666114 | B1 | 1/2007 |

*Primary Examiner* — Kevin M Nguyen
(74) *Attorney, Agent, or Firm* — Birch, Stewart, Kolasch & Birch, LLP

(57) ABSTRACT

Provided is an apparatus for improving image quality of a display device including a panel for displaying an image according to an inputted image signal a lamp for illuminating the panel an inverter for applying a drive current to the lamp and a control unit for intermittently applying a driving pulse voltage of the inverter to perform pulse width modulation dimming, and varying an operating frequency of the inverter, wherein the control unit detects frequencies of horizontal and vertical synchronizing signals and varies a pulse width modulation frequency regardless of the horizontal and vertical synchronizing signals.

10 Claims, 3 Drawing Sheets

[Fig. 1]
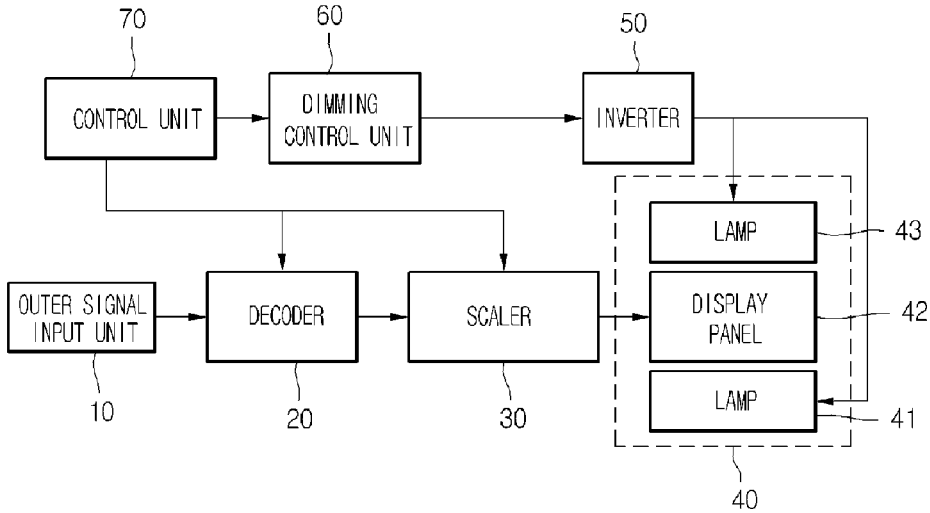
[Fig. 2]
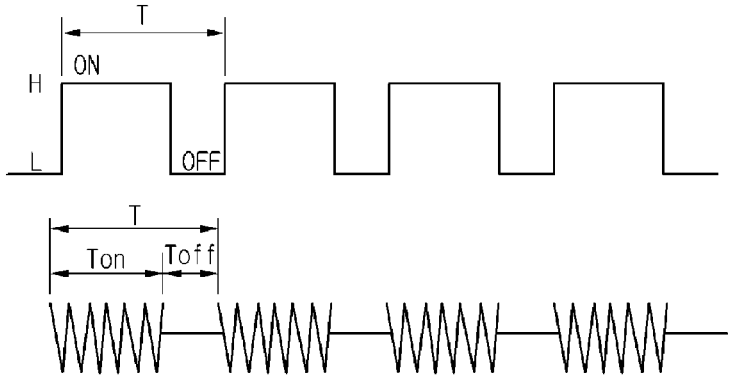
[Fig. 3]
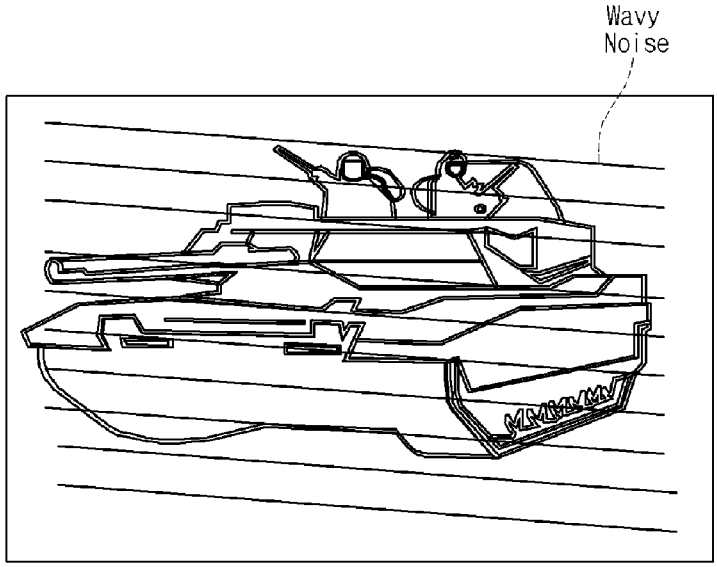

[Fig. 4]
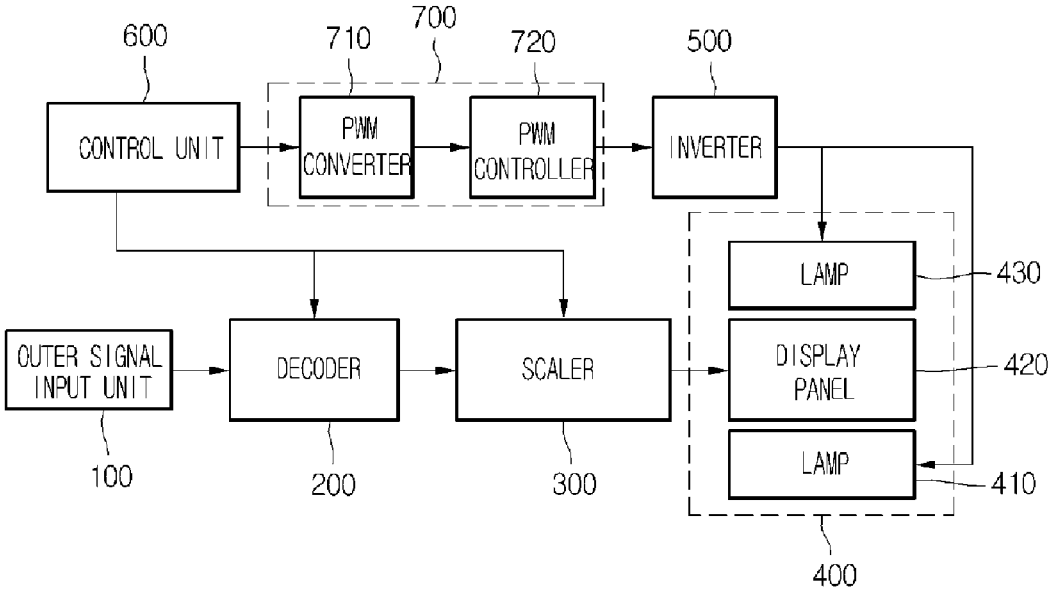
[Fig. 5]
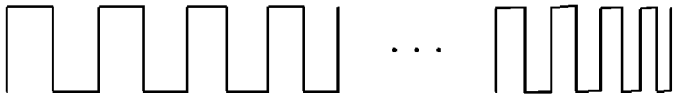
PWM Inverter Control SIGNAL

[Fig. 6]
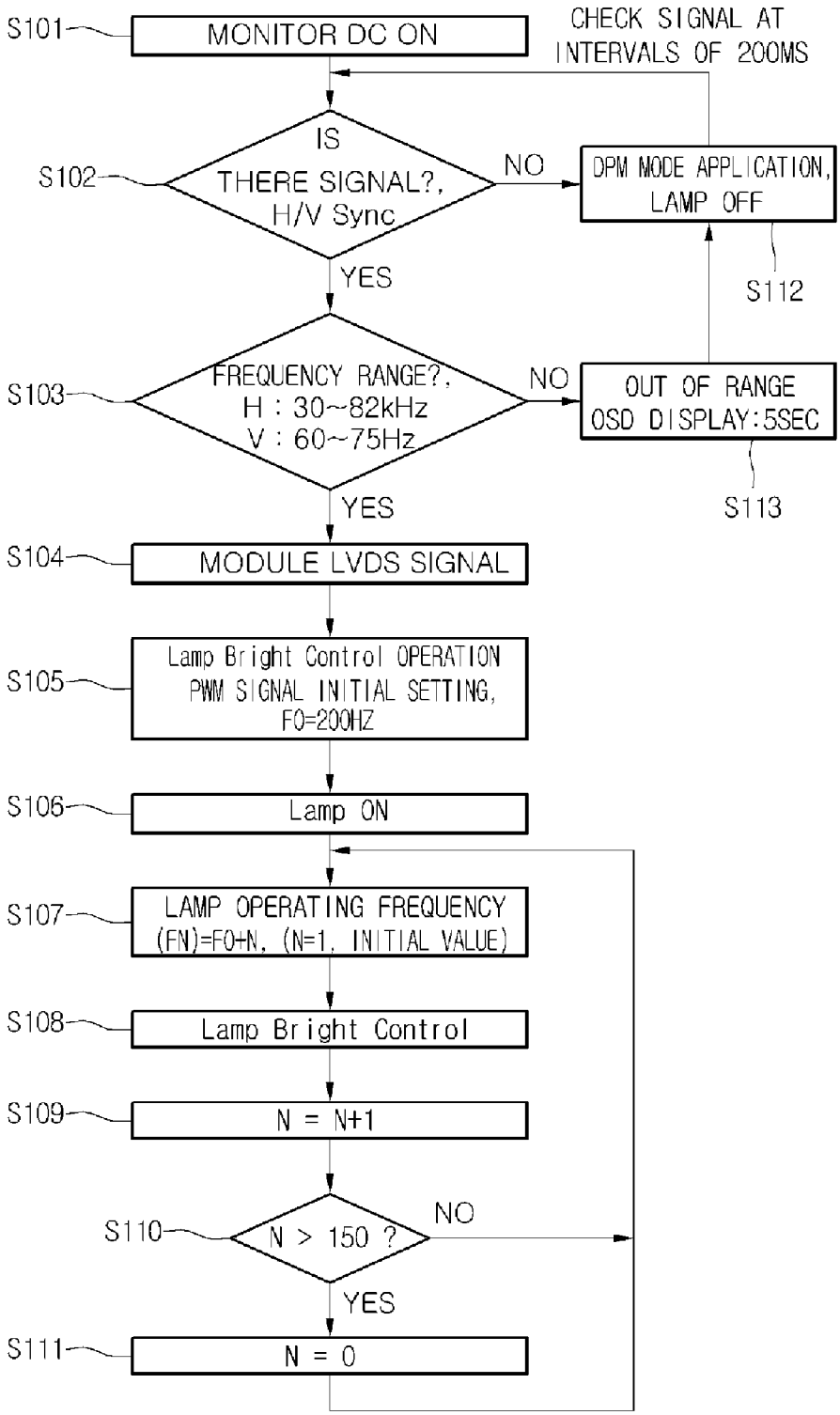

APPARATUS AND METHOD FOR IMPROVING VIDEO QUALITY OF DISPLAY DEVICE

FIELD OF THE INVENTION

Embodiments relate to an apparatus and a method for improving video quality of a display device.

BACKGROUND ART

Generally, a display device is classified into a self-emissive type such as a plasma display panel displaying an image using a plasma discharge system and a non-emissive type displaying an image using a light source of a backlight lamp.

As the non-emissive type display device, a liquid crystal display (LCD) device can be exampled. The LCD includes an inverter for supplying alternating current power to a backlight lamp and a dimming circuit for continuously varying brightness of the backlight lamp.

Meanwhile, as a dimming method, an analog dimming method that varies an amplitude of the voltage by detecting current flowing in the backlight lamp and feed-backing the detected current in the form of voltage is well known.

However, the analog dimming method couldn't meet the certificate standard by the Swedish Confederation Of Professional Employee (TCO) "03" since its dimming ratio of maximum luminance to minimum luminance is approximately 2:1.

Recently, a burst mode type dimming (or pulse width modulation (PWM) dimming) that can realize the dimming by adjusting an on/off duty of a power supply switch according to a dimming frequency has been used.

The burst mode type dimming will now be described with reference to the accompanying drawing.

Referring first to FIG. 1, an LCD device includes an outer signal input unit 10 for receiving an image signal from an external side and pre-processing the image signal, a decoder 20 for decoding the image signal pre-processed by the outer signal input unit 10 using MPEG 2, a scaler (or a video processor) 30 for converting the image signal decoded by the decoder 20 into a format appropriate for a screen on which the image will be displayed, and an display unit 40 for displaying the image signal scaled by the scaler 30.

The LCD device further includes an inverter 50 for supplying driving alternating current power for controlling brightness of the display unit 40, a dimming control unit 60 for performing the dimming by controlling a switching of the alternating current power supply, and a control unit 70 for generally controlling the display of the image signal as well as the dimming.

The display unit 40 includes a display panel 42 for displaying the image signal scaled by the scaler 30, and lamps 41 and 43 supplying light to the display panel 42.

As shown in FIG. 2, the control unit 70 applies a dimming frequency 1/T of the burst mode to the dimming control unit 60. The inverter 50 receiving the generated dimming signal controls the on/off Ton/Toff of the alternating current power supply for driving the lamps 41 and 43.

According to the above-described LCD device, although the image signals inputted from the external side have different formats having different vertical synchronizing frequencies, only one dimming frequency set in the dimming control unit 60 is used. Accordingly, resonance may be generated between the vertical synchronizing frequency freq_v_sync and the dimming frequency freq_Dim to generate a wavy noise on a predetermined portion of the screen.

For example, when the inputted image signals having different formats have vertical synchronizing frequencies of 56 Hz, 60 Hz, 70 Hz, 72 Hz, and 75 Hz while the dimming frequency set at the dimming control unit 60 is fixed at 65 Hz, resonance may be generated between a frequency of the image signal and the dimming frequency.

The resonance may be more frequently generated when the image signal having frequency of 60 Hz or 70 Hz similar to the dimming frequency of 65 Hz is inputted.

The noise may be also generated by the resonance between the horizontal synchronizing frequency and the dimming frequency. FIG. 3 illustrates wavy noise generated on a display.

SUMMARY OF THE INVENTION

Embodiments provide an apparatus and a method for improving video quality of a display device.

Technical Solution in one embodiment, an apparatus for improving image quality of a display device includes: a panel for displaying an image according to an inputted image signal; a lamp for illuminating the panel; an inverter for applying a drive current to the lamp; and a control unit for intermittently applying a driving pulse voltage of the inverter to perform pulse width modulation dimming, and varying an operating frequency of the inverter, wherein the control unit detects frequencies of horizontal and vertical synchronizing signals and varies a pulse width modulation frequency regardless of the horizontal and vertical synchronizing signals.

In another embodiment, a method for improving image quality of a display device includes: determining whether an image signal is received when the display device is on; detecting a frequency of a vertical or horizontal synchronizing signal of the received image signal when the image signal is received; performing pulse width modulation dimming using an inverter applying a drive current to a lamp when the vertical or horizontal frequency is higher than a predetermined reference frequency; and displaying an image on a panel through the pulse width modulation dimming, wherein the pulse width modulation dimming comprises varying a pulse width modulation frequency regardless of a size of the frequency of the vertical or horizontal synchronizing signal.

An apparatus and a method according to an embodiment allow an inverter to operate in a variable frequency type rather than in a specific frequency type. Accordingly, screen noises which are generated from synchronization between an inverter operating frequency and a screen operating frequency can be reduced. Also, since synchronized points do not occur on a screen, a wavy noise can be reduced.

The apparatus and the method can be applied to minute change of an inputted frequency or all frequency ranges of signals to reduce noise.

Furthermore, The apparatus and the method can be applied to all modes regardless of the inputted frequency to reduce noise

BRIEF DESCRIPTION OF THE DRAWINGS

FIG. 1 is a block diagram of a display device having a related art dimming circuit;

FIG. 2 is a waveform illustrating a dimming signal of general PWM dimming type;

FIG. 3 is a diagram illustrating wavy noise on a display device;

FIG. 4 is a block diagram of an apparatus for improving video quality of a display device according to an embodiment;

FIG. 5 is a waveform diagram of variable PWM operating frequency according to an embodiment; and FIG. 6 is a flowchart illustrating a method for improving video quality of a display device according to an embodiment.

BEST MODE FOR CARRYING OUT THE INVENTION

Hereinafter, preferred embodiments of the present invention will be described in detail with reference to accompanying drawings.

FIG. 4 is a block diagram of an apparatus for improving video quality of a display device according to an embodiment. FIG. 5 is a waveform diagram of variable PWM operating frequency according to an embodiment. FIG. 6 is a flowchart illustrating a method for improving video quality of a display device according to an embodiment.

Referring to FIG. 4, the display device according to an embodiment includes an outer signal input unit 100, a decoder 200, a scaler 300, an display unit 400, an inverter 500, a control unit 600, and PWM unit 700.

The outer signal input unit 100 receives an image signal from an external side and pre-processes the image signal. The decoder 200 decodes the image signal encoded into MPEG 2 or the like by the outer signal input unit 100.

The decoder 200 decodes the image signal (which is encoded using MPEG 2) inputted from the outer signal input unit 100 using MPEG 2.

The scaler 300 scales the image signal decoded by the decoder 200 into a pre-determined screen size and resolution. The display unit 400 displays the image signal scaled by the scaler 300. Also, the inverter 500 supplies driving alternating current power for controlling brightness of the display unit 400. The control unit 600 continuously varies the PWM operating frequency based on initial PWM operating frequency for controlling brightness of the display unit 400. The PWM unit 700 transfers the PWM operating frequency to inverter 500 according to control signal of the control unit 600.

The display unit 400 includes a display panel 420 and one or more lamps 410 and 430. The display panel 420 displays the image signal scaled by the scaler 300. The lamps 410 and 430 emit light toward a front face of the display panel 420.

Also, the PWM unit 700 includes a PWM converter 710 and a PWM controller 720. The PWM converter 710 outputs the PWM operating frequency varied continuously from the initial PWM operating frequency within a predetermined range. The PWM controller 720 applies the PWM operating frequency varied through the PWM converter 710 to the inverter 500 to control alternating current power.

Operations of the apparatus for improving video quality of a display device according to the embodiment will be described hereinafter.

The outer signal input unit 100 is provided to process image signals inputted from an external side. The outer signal input unit 100 may include a variety of outer signal input interfaces such as an antenna cable, an RCA cable, an S-video cable, and the like. The outer signal input unit 100 may further include a tuner for selecting a channel and a de-multiplexer for separating a sound signal and an image signal from a multiplexing image signal.

The decoder 200 decodes the inputted image signal using MPEG 2 or the like.

The scaler 300 scales the image signal outputted from the decoder 200 into a pre-determined screen size or resolution and superimposes an on-screen-display (OSD) signal outputted from an OSD generator (not shown) with the image signal to display an image on the screen.

The display panel 420 includes a thin film transistor (TFT) and backlight lamps 410 and 430. The display panel 420 displays the image signal outputted from the scaler 300. When voltage is applied to specific liquid crystal molecules, the orientation of the molecules is changed. The change of the optical property of the liquid crystal cell by the reorientation of the liquid crystal molecules is changed into a visual change.

A cold cathode fluorescent lamp is widely used as the lamps 410 and 430. In addition, LEDs or an external electrode fluorescent lamp (EEFL) used for an LCD TV requiring a high luminance may also be used as the backlight lamp.

The inverter 500 provides high frequency alternating current power for driving the lamps 410 and 430 using the varied PWM frequency inputted from the PWM controller 720.

The control unit 600 controls the inverter intermittently to apply driving pulse voltage for a PWM dimming. Particularly, the PWM dimming is performed in accordance with PWM operating frequency varied regardless of frequency of a vertical or horizontal synchronizing signal in some cases.

More specifically, the control unit 600 outputs a controlling signal so as continuously to vary the PWM operating frequency within a predetermined range, based on initial PWM operating frequency for controlling the driving alternating current power provided from the inverter 500 to the lamps 410 and 430.

Then, the PWM converter 710 continuously varies the initial PWM operating frequency within a predetermined range to output the varied PWM operating frequency.

The initial PWM operating frequency is approximately 200 Hz. Flicker may be generated when the PWN operating frequency is lower than approximately 200 Hz. Accordingly, the PWM operating frequency is varied in a predetermined frequency range to prevent the flicker.

The range of the PWM operating frequency is approximately 200 Hz to approximately 300 Hz. The PWM converter 710 set the PWM operating frequency to the initial PWM operating frequency when the variable PWM operating frequency becomes higher than approximately 350 Hz.

This is because that an operation of the lamps 410 and 430 becomes unstable when a predetermined duty is given due to the PWM operating frequency higher than approximately 350 Hz. Accordingly, the PWM operating frequency is set within approximately 250 Hz to approximately 350 Hz and varied within the frequency range to output the PWM operating frequency.

For example, the PWM converter 710 increases the PWM frequency from approximately 200 Hz by approximately 1 Hz to output the PWM frequency. When the PWM operating frequency is higher than approximately 350 Hz, the PWM operating frequency to be outputted is returned to approximately 200 Hz.

The PWM converter 720 controls a supply of alternating current power provided from the inverter 500 to the lamps 410 and 430 using the PWM operating frequency outputted from the PWM converter 710. The PWM converter 720 hereby controls light-emitting of the lamps 410 and 430, and further provides a user with screen of a desired brightness.

That is, the PWM controller 720 switches on or off a supply of the alternating current supplied to the lamps 410 and 430 according to the PWM operating frequency to control the light-emitting of the lamps 410 and 430.

Particularly, the control unit 600 maintains a duty of the PWM uniform while the PWM frequency is varied. Accordingly, amount of light emitted from the lamps 410 and 430 is maintained uniform.

The apparatus for improving video quality of a display device according to the embodiment includes varying the PWM operating frequency to output the PWM operating frequency, and controlling brightness of a LCD monitor and an electric current of the lamps using the PWM operating frequency. Therefore, the brightness of the monitor can be optimally controlled regardless of various vertical frequencies of the monitor.

Referring to FIG. 6, a method for improving video quality of a display device according to an embodiment includes firstly determining whether a signal is inputted when DC power source of the display device is on (S101 and S102). That is, it is determined whether a vertical or horizontal synchronizing signal (H/V_sync) is inputted.

After the determination (102), when an inputted signal exists, it is determined whether a frequency range of the inputted signal belongs to a permissible frequency range (S103). That is, it is determined whether the horizontal frequency belongs to the range of approximately 30 Hz to approximately 82 Hz, and the vertical frequency belongs to the range of approximately 60 Hz to approximately 75 Hz.

After the determination (S103), the inputted signal is outputted when the frequency of the inputted signal belongs to the permissible frequency range (S104).

Next, an initial frequency Fo is set to control the brightness of the lamps 410 and 430 (S105). That is, the PWM operating frequency Fo is set to approximately 200 Hz. This is because that flicker may be generated when the PWM operating frequency is lower than approximately 200 Hz.

Next, on the basis of the initial PWM operating frequency, lamp is turned on (S106).

Next, the PWM operating frequency is varied within a predetermined range (S107). That is, the PWM operating frequency Fo increases from the initial PWM operating frequency by approximately 1 Hz. That is, the PWM operating frequency Fn equals the initial PWM operating frequency plus N, where the default value of the N is approximately 1. The PWM operating frequency is increased by approximately 1 Hz to be outputted, and then sequentially increased by approximately 2 Hz, approximately 3 Hz, approximately 4 Hz. Accordingly, a current PWM operating frequency will be approximately 201 Hz.

Then, the PWM operating frequency is outputted to control the brightness of the lamps 410 and 430.

Next, approximately 1 Hz is added to the N value of operation S107 (S109). That is, a frequency N added to the initial PWM operating frequency set to vary the PWM operating frequency is the prior N value plus approximately 1. Every PWM operating frequency is increased by approximately 1 to output the PWM operating frequency.

Next, it is determined whether N value is higher than approximately 150 (S110). When the N value is approximately 150, the PWM operating frequency to be outputted becomes 350 Hz. However, an operating of the lamps 410 and 430 may be unstable when the PWM operating frequency is higher than approximately 350 Hz. Accordingly, it should be determined whether the N value is higher than approximately 150.

After the determination, when the N value is not higher than approximately 150, operation 107 is resumed. Then, N value set through operation S109 is added to the initial PWM operating frequency. The PWM operating frequency to which N value is added is outputted to control the brightness of the lamps 410 and 430.

When the N value is higher than approximately 150, the N value is set to zero. Operation 107 is resumed. That is, when the PWM operating frequency is higher than approximately 350 Hz, the PWM operating frequency is set to the initial PWM operating frequency, approximately 200 Hz, to output the PWM operating frequency.

Meanwhile, according to a result of operation S102, when a signal is not inputted, display power management (DPM) mode is applied to turn off the lamps 410 and 430. Also, it is determined whether a signal is inputted every a predetermined time interval (200 ms).

According to a result of operation S103, when a frequency of the inputted signal does not belong to the permissible frequency range, a message indicating that the frequency of the inputted signal is out of the permissible frequency range is outputted for five seconds (displaying "out of Range" on OSD). Next, operation S112 is resumed (S113).

That is, the embodiment changes a fixed frequency type into a variable frequency type, thereby preventing horizontal wavy noise on a screen and reducing the noise.

As described above, the apparatus and the method according to an embodiment can output the variable PWM operating frequency regardless of an inputted frequency in all frequency bands to improve the wavy noise on the screen and optimally to control brightness of the screen.

INDUSTRIAL APPLICABILITY

The embodiments can improve image quality of a display device, thereby having an industrial applicability.

The invention claimed is:

1. An apparatus for improving image quality of a display device, the apparatus comprising:

a screen for displaying an image according to an inputted image signal;

a lamp for illuminating the screen;

an inverter for applying a drive current to the lamp; and a control unit for intermittently applying a driving pulse voltage of the inverter to perform pulse width modulation dimming, outputting a control signal continuously to vary a pulse width modulation operating frequency within a predetermined range based on an initial pulse width modulation operating frequency, and outputting an alternating current power from the inventor to the lamps based on the varied pulse width modulation operating frequency, wherein the control unit changes the pulse width modulation operating frequency into the initial pulse width modulation operating frequency when the varied pulse width modulation operating frequency reaches a predetermined frequency.

2. The apparatus according to claim 1, wherein the control unit varies the pulse width modulation operating frequency while maintaining a duty of pulse width modulation.

3. The apparatus according to claim 1, wherein the control unit gradually increases the pulse width modulation operating frequency step by step.

4. The apparatus according to claim 1, wherein the initial pulse width modulation operating frequency is a default value.

5. The apparatus according to claim 1, wherein the control unit changes the pulse width modulation operating frequency when a vertical or horizontal synchronizing signal has a frequency higher than a predetermined reference frequency.

6. The apparatus according to claim 1, wherein the control unit varies the pulse width modulation operating frequency within the frequency range of approximately 200 Hz to approximately 350 Hz.

7. The apparatus according to claim 6, wherein the control unit sets the initial pulse width modulation operating frequency to approximately 200 Hz.

8. A method for improving image quality of a display device, the method comprising:

determining whether an image signal is received when the display device is on;

detecting a frequency of a vertical or horizontal synchronizing signal of the received image signal when the image signal is received;

setting an initial pulse width modulation operating frequency when the vertical or horizontal frequency is higher than a predetermined reference frequency;

varying a pulse width modulation operating frequency by gradually increasing the pulse width modulation operating frequency while the image signal is received; and reducing the pulse width modulation operating frequency to the initial pulse width modulation operating frequency when the varied pulse width modulation operating frequency is higher than the predetermined reference frequency.

9. The method according to claim 8, wherein the pulse width modulation operating frequency is reduced to the initial pulse width modulation operating frequency when the varied pulse width modulation frequency reaches a reference frequency set in advance.

10. The method according to claim 8, wherein the pulse width modulation operating frequency is variable within the frequency range of approximately 200 Hz to approximately 350 Hz.

* * * * *